US009442464B2

(12) United States Patent
Singleton

(10) Patent No.: US 9,442,464 B2
(45) Date of Patent: Sep. 13, 2016

(54) SPORTING TIMER

(71) Applicant: William Singleton, Wayne, MI (US)

(72) Inventor: William Singleton, Wayne, MI (US)

( * ) Notice: Subject to any disclaimer, the term of this patent is extended or adjusted under 35 U.S.C. 154(b) by 0 days.

(21) Appl. No.: 14/591,894

(22) Filed: Jan. 7, 2015

(65) Prior Publication Data

US 2015/0192902 A1 Jul. 9, 2015

Related U.S. Application Data

(60) Provisional application No. 61/924,764, filed on Jan. 8, 2014.

(51) Int. Cl.

| | |
|---|---|
| ***G04G 11/00*** | (2006.01) |
| ***G04G 21/04*** | (2013.01) |
| ***G04F 1/00*** | (2006.01) |
| ***A63B 43/00*** | (2006.01) |
| ***A63B 63/00*** | (2006.01) |
| ***A63B 71/06*** | (2006.01) |

(52) U.S. Cl.

CPC ..... *G04G 11/00* (2013.01); *A63B 43/00* (2013.01); *A63B 63/004* (2013.01); *A63B 71/06* (2013.01); *G04F 1/005* (2013.01); *G04G 21/04* (2013.01); *A63B 71/0619* (2013.01)

(58) Field of Classification Search

CPC ..... G04F 1/005; G04G 21/04; G04G 11/00; A63B 71/06; A63B 71/0619; A63B 43/00; A63B 63/004

USPC ..... 368/10, 11, 107, 110

See application file for complete search history.

(56) References Cited

U.S. PATENT DOCUMENTS

| | | | | | |
|---|---|---|---|---|---|
| 3,981,002 | A * | 9/1976 | Gardner | G04G 9/107 | 340/323 R |
| 4,637,732 | A * | 1/1987 | Jones | G04C 10/04 | 340/309.16 |
| 5,293,354 | A * | 3/1994 | Costabile | G04F 8/08 | 368/11 |
| 6,369,697 | B1 * | 4/2002 | Poole | G07C 1/28 | 340/12.54 |
| 6,603,711 | B2 * | 8/2003 | Calace | A63B 71/0605 | 368/10 |
| 6,798,392 | B2 * | 9/2004 | Hartwell | A42B 3/046 | 345/158 |
| 6,945,887 | B2 * | 9/2005 | Oister | A63B 43/00 | 473/570 |
| 7,185,439 | B1 * | 3/2007 | Nubin | G01S 5/02 | 33/289 |
| 7,218,216 | B1 * | 5/2007 | Uehran | A63B 71/06 | 340/517 |
| 7,559,164 | B1 * | 7/2009 | Riehlman | A63B 71/0619 | 340/815.53 |
| 7,920,052 | B2 * | 4/2011 | Costabile | A63B 71/0605 | 340/323 R |
| 8,054,174 | B1 * | 11/2011 | Uehran | A63B 71/0605 | 273/317.3 |
| 2004/0184354 | A1 * | 9/2004 | McDonald | G04G 21/04 | 368/3 |
| 2008/0184571 | A1 * | 8/2008 | Kivley | G06Q 30/02 | 33/289 |
| 2009/0267748 | A1 * | 10/2009 | Bailey | A63B 71/0619 | 340/323 R |
| 2011/0032086 | A1 * | 2/2011 | Cabrera | A41D 20/00 | 340/323 R |
| 2014/0189937 | A1 * | 7/2014 | Pietrzak | A42B 3/042 | 2/411 |
| 2014/0259708 | A1 * | 9/2014 | Foster | A63B 71/0605 | 33/289 |
| 2014/0309059 | A1 * | 10/2014 | Minch | A63B 43/06 | 473/422 |

* cited by examiner

*Primary Examiner* — Vit W Miska

(74) *Attorney, Agent, or Firm* — Vincent Re PLLC

(57) ABSTRACT

An apparatus including a mobile timer unit for use in a sporting event is disclosed. The mobile timer unit includes a timer unit controller in communication with a remote master timer controller and an output device in communication with the timer unit controller. The mobile timer unit is operated wirelessly upon a moving object within the context of game play of the sporting event.

8 Claims, 7 Drawing Sheets

SPORTING TIMER

CROSS REFERENCE TO RELATED APPLICATIONS

This disclosure claims the benefit of U.S. Provisional Application No. 61/924,764 filed on Jan. 8, 2014 which is hereby incorporated by reference.

TECHNICAL FIELD

This disclosure is related to a timer used in a sporting event. In particular, the disclosure is related to a timer located proximately to the field such that players can readily observe the timer.

BACKGROUND

The statements in this section merely provide background information related to the present disclosure. Accordingly, such statements are not intended to constitute an admission of prior art.

Sporting events can include a timer important to the rules of the game. In American football, the game includes a timer that determines when a quarter of the game ends. Additionally, a play clock provides a set period of time in which a next play must be started to avoid a penalty. Similarly, basketball includes both a game clock and a shot clock. Soccer and hockey both include game clocks. In all of these sports, an athlete completing an action or taking a shot by expiration of a timer can be critical to game play.

Sporting venues include clocks or timers on display, showing the athletes, officials, broadcasters, and fans the relevant game time, play clock, or shot clock. Such a clock can be located upon a score board or a display located upon a wall of the sporting arena.

SUMMARY

An apparatus including a mobile timer unit for use in a sporting event is disclosed. The mobile timer unit includes a timer unit controller in communication with a remote master timer controller and an output device in communication with the timer unit controller. The mobile timer unit is operated wirelessly upon a moving object within the context of game play of the sporting event.

BRIEF DESCRIPTION OF THE DRAWINGS

One or more embodiments will now be described, by way of example, with reference to the accompanying drawings, in which.

DETAILED DESCRIPTION

Figure 1:
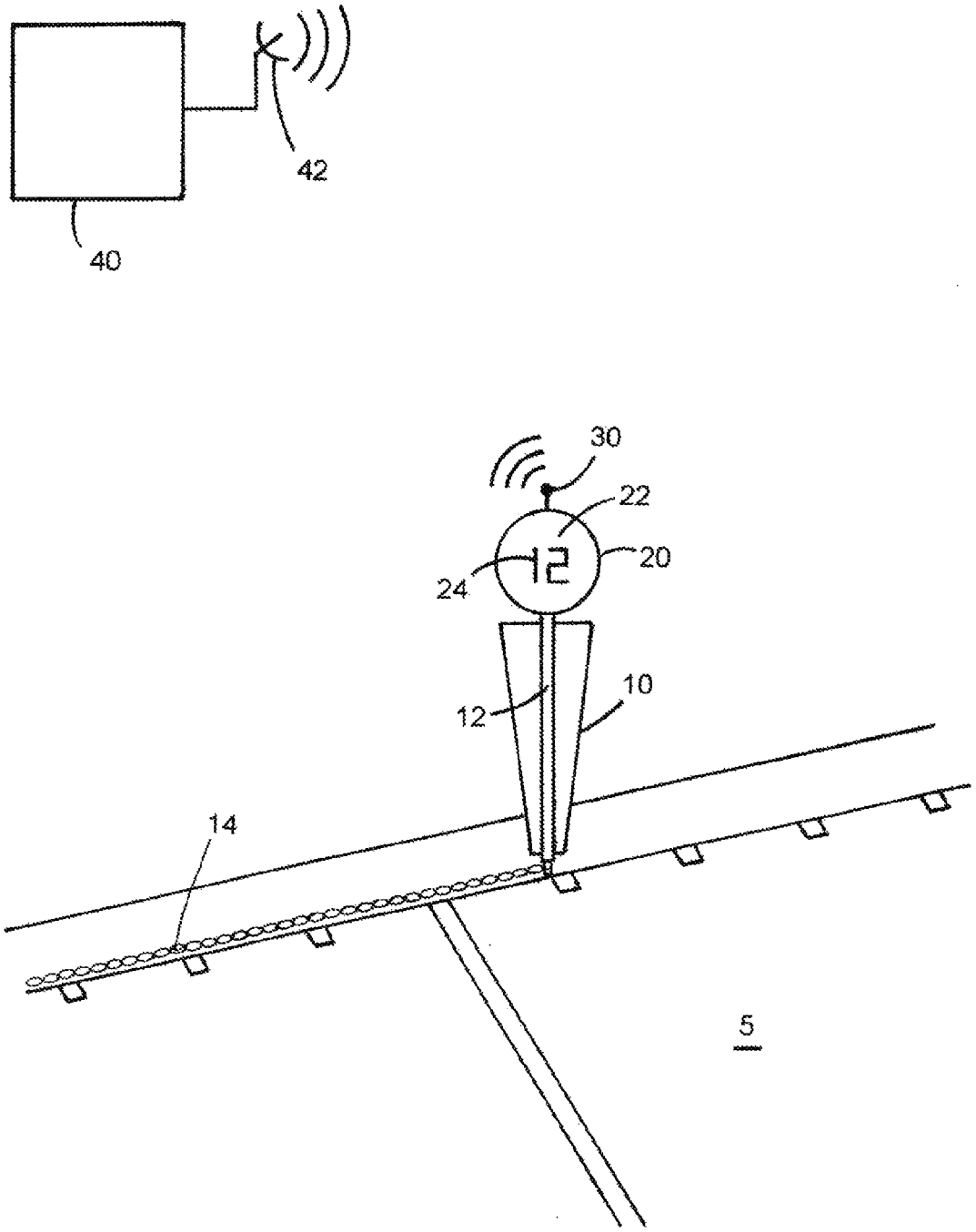
FIG. 1 illustrates an exemplary first down marker equipped with a mobile timer unit, in accordance with the present disclosure.

Referring now to the drawings, wherein the showings are for the purpose of illustrating certain exemplary embodiments only and not for the purpose of limiting the same, a mobile timer unit can be situated proximately to a playing surface such that output from an output device can be immediately communicated to a player or the players within the context of the playing surface. In one embodiment, in order to be easily perceived by the players in the context of the game play, the mobile timer units are operated wirelessly upon moving objects within the context of the game play.

FIG. 1 illustrates an exemplary first down marker equipped with a mobile timer unit situated on a sideline of a playing field. First down marker pole 10 is to designate a position on an American football field 5 to which a team must get to achieve a first down. Marker pole 10 includes pole 12 and mobile timer unit 20 positioned proximately to field 5, such that players upon the field can easily see numbers 24 upon display 22 of unit 20. Marker pole 10 is connected to a another marker pole with chain 14, where typically chain 14 is 10 yards in length. A sideline disclosed herein is intended to be inclusive and can include any border adjacent to the field of play. For example, a timer device could be displayed at the end of an end zone during field goal attempts to make sure the kicker has every opportunity to know the status of the play clock.

Mobile timer unit 20 includes a communications device 30 to communicate with a master timer controller 40. Controller 40 is configured to receive inputs related to the progress of the sporting event being played, for example, through input of an official timekeeper. Controller 40 is additionally configured to communicate with display devices such as a scoreboard and other display units that can communicate important information such as a timer countdown. In football, such a countdown can include a play clock or a game clock. Controller 40 can include a communications device 42 configured to communicate with device 30 of mobile timer unit 20. In this way, an official timer or countdown can be displayed upon mobile timer unit 20.

Figure 2:
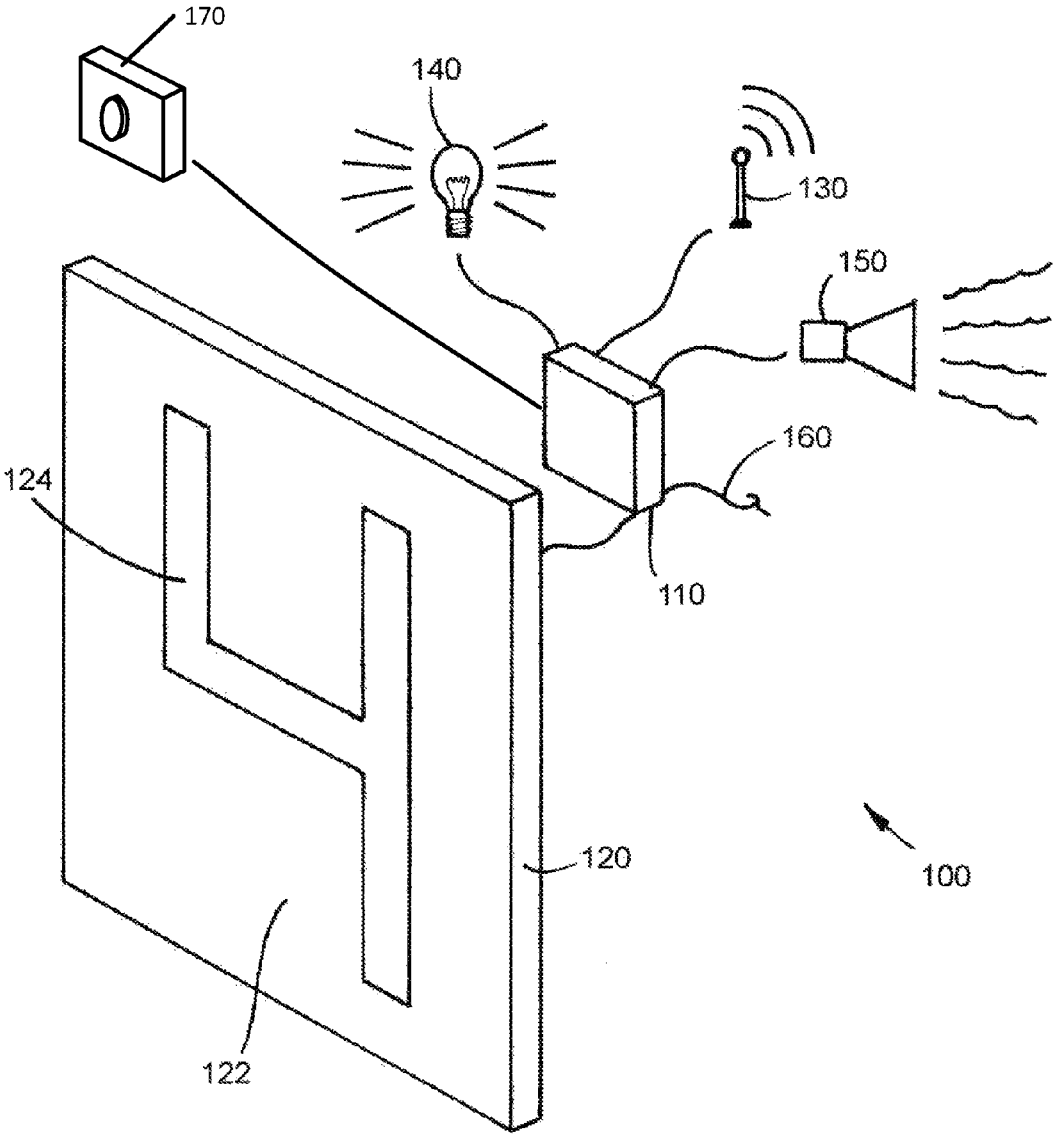
FIG. 2 illustrates components of an exemplary mobile timer unit, in accordance with the present disclosure.

FIG. 2 illustrates components of an exemplary mobile timer unit. Mobile timer unit 100 includes a controller 110 in communication with several devices including display unit 120, communications device 130, light effect 140, sound effect 150, and communication line 160 leading to a second display unit. Display unit 120 includes display 122 illustrating number 124. Display unit 120 is illustrated as an exemplary liquid crystal display device. A liquid crystal display can include a device displaying black lettering on a gray background as is frequently used in digital clocks, or a liquid crystal display can include a spectrum of colors and utilize technology similar to a computer display. A number of different display devices are envisioned for use with the present disclosure, including but not limited to LED displays, incandescent or halogen light bulbs, or other similar displays known in the art capable of displaying a countdown or a timer. An optional video/camera device 170 is illustrated. Such camera devices are known in the art and can be small and lightweight. Because unit 100 is in wireless communication with remote systems, it can be advantageous to place a camera upon the device to provide an additional viewpoint to a replay booth or for use in a telecast of the game. Additionally, image recognition software can be used with the camera, for example, to provide a measure of when the ball crosses between two markers located across the field from each other to provide an output such as a halo flash.

Figure 3:
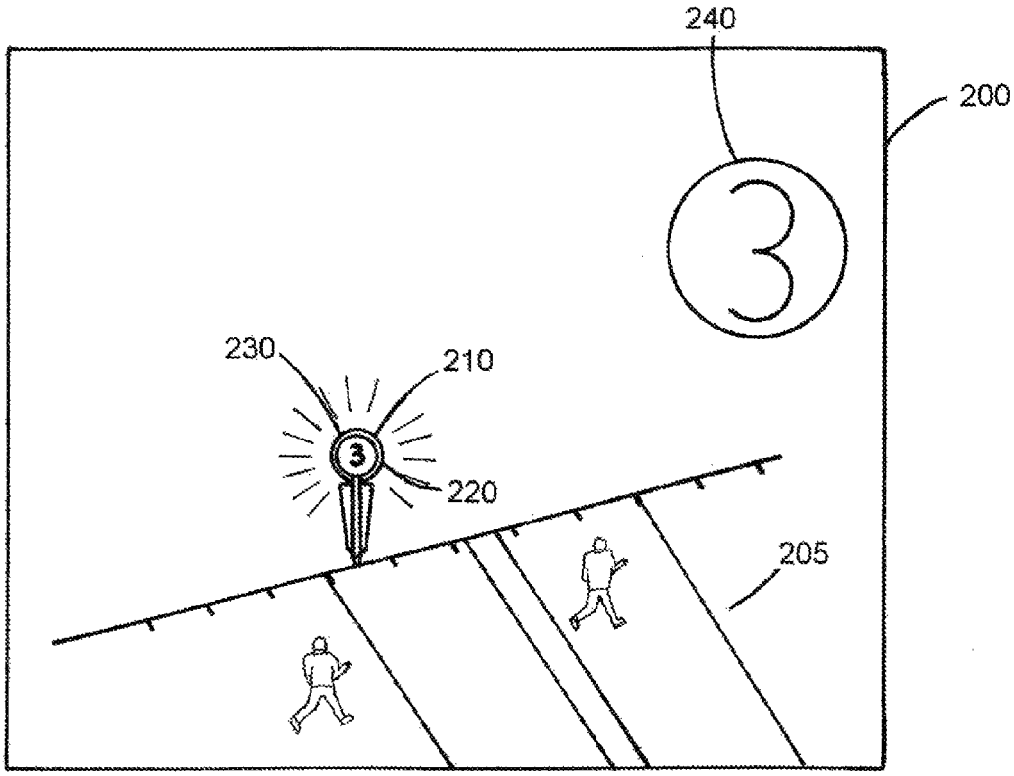
FIG. 3 illustrates an exemplary video display showing a mobile timer unit and enhanced graphics that can be displayed based upon the unit, in accordance with the present disclosure.

FIG. 3 illustrates an exemplary video display showing a mobile timer unit and enhanced graphics that can be displayed based upon the unit. Video display 200 includes an image projected upon a viewing device such as a television screen or a computer monitor. An image of playing field 205 including marker pole 210 is displayed. Display 220 of marker pole 210 is visible displaying a countdown timer. Methods are known in the art to enhance a video graphic, for example, by providing an enhanced graphic upon a view of the playing field embodied as yellow line projected upon the field corresponding to a location that a team must advance past to receive a first down. Halo light 230 is illustrated surrounding display 220, such that a light can be configured to be displayed according to a timer status. For example, a halo light can start to slowly pulse yellow with ten seconds left on the timer and more rapidly pulse red with five seconds left on the timer. The halo light can turn solid red when the timer expires. An audio signal can additionally be activated. Halo light 230 or a similar light display associated with marker pole 210 can be embodied as a physical light upon the mobile timer unit. In one embodiment, halo light 230 can additionally or alternatively be displayed or enhanced using an enhanced graphic projected upon or around the mobile timer unit. An enhanced television display controller can be used in combination with a controller used to control the display 220 and halo light 230 to coordinate enhanced visual themes upon a telecast of the event with the on-screen display provided by the telecast. By coordinating the controllers, viewers of the game can see time relevant enhanced graphics at the same time as players see the displays upon the pole mounted devices. In one embodiment, a inset close-up graphic 240 of the timer device can be projected upon display 200.

Figure 4:
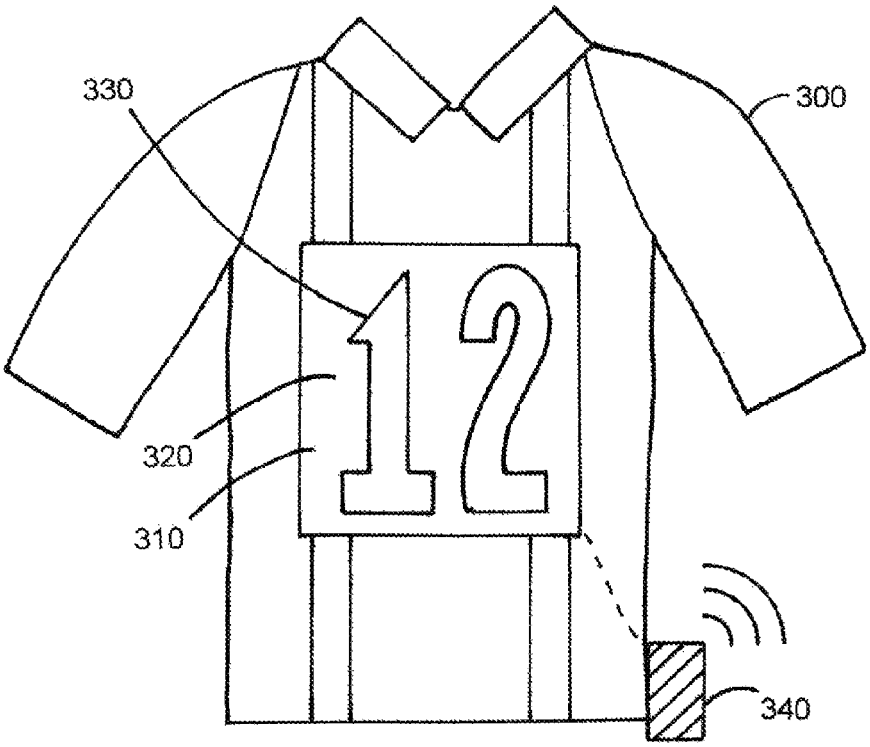
FIG. 4 illustrates an exemplary mobile timer unit mounted upon a referee jersey, in accordance with the present disclosure.

A mobile timer unit can be situated upon poles or other objects in the proximity to the playing field. However, poles cannot be situated upon the field of play as they would interfere with the players. FIG. 4 illustrates an exemplary mobile timer unit mounted upon a referee jersey. By locating a timer display upon the jersey of an official on the field, a timer can be presented to players within the playing environment. Jersey 300 is illustrated including display device 310 and controller unit 340. Display device 310 includes display 320 and displayed numbers 330. Display device 310 is preferably lightweight and is securely connected to the jersey 300 such that the official can run on the field as required to keep up with the game. Controller unit 340 is in communication with a remote master timer controller.

Figure 5:
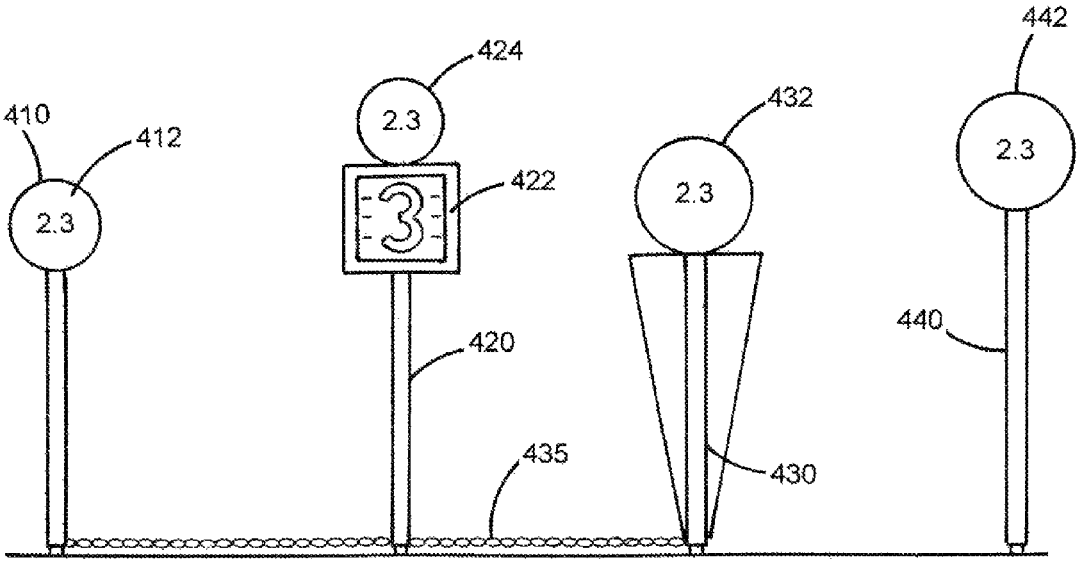
FIG. 5 illustrates exemplary mobile timer units mounted upon a plurality of poles, in accordance with the present disclosure.

FIG. 5 illustrates exemplary mobile timer units mounted upon a plurality of poles. Marker pole 410 is located at a first down location and is connected by ten yard chain to first down marker pole 430. Down marker 420 is located during each play at a point where the ball initially starts. Marker pole 410 includes mobile timer unit 412, marker pole 420 includes down display 422 and mobile timer unit 424, and marker pole 430 includes mobile timer unit 432. Additionally a separate pole 440, not connected with normal sideline duties, can be employed to provide mobile timer unit 442.

Figure 6:
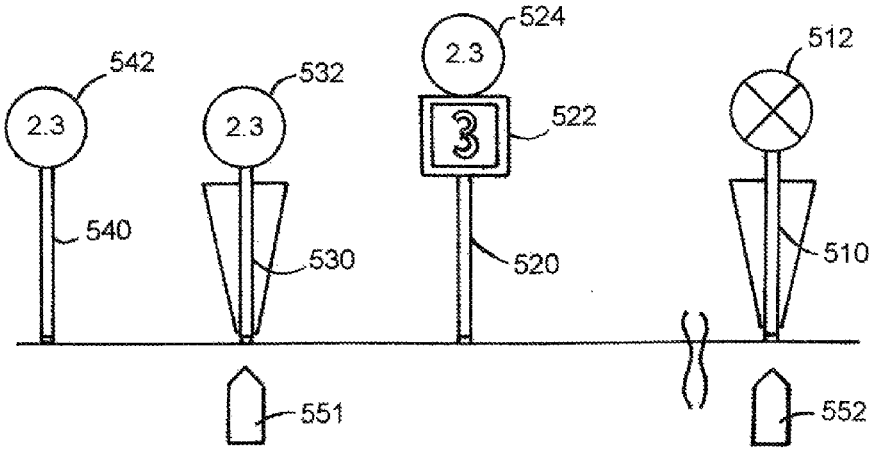
FIG. 6 illustrates exemplary mobile timer units mounted upon a plurality of poles on an opposite side of a playing field from the poles of FIG. 5, in accordance with the present disclosure.

FIG. 6 illustrates exemplary mobile timer units mounted upon a plurality of poles on an opposite side of a playing field from the poles of FIG. 5. Marker pole 510 is located at a drive start location. In one embodiment, pole 510 can include a timer display. In another embodiment, because a pole at a drive start location can be situated on only one side of a field, pole 510 can include marker 512 not including a timer so as not to provide an unfair advantage to the team on that side of the field. Down marker 520 is located during each play at a point where the ball initially starts. Marker pole 520 includes down display 522 and mobile timer unit 524. First down marker pole 530 includes mobile timer unit 532. Additionally a separate pole 540, not connected with normal sideline duties, can be employed to provide mobile timer unit 542.

Figure 7:
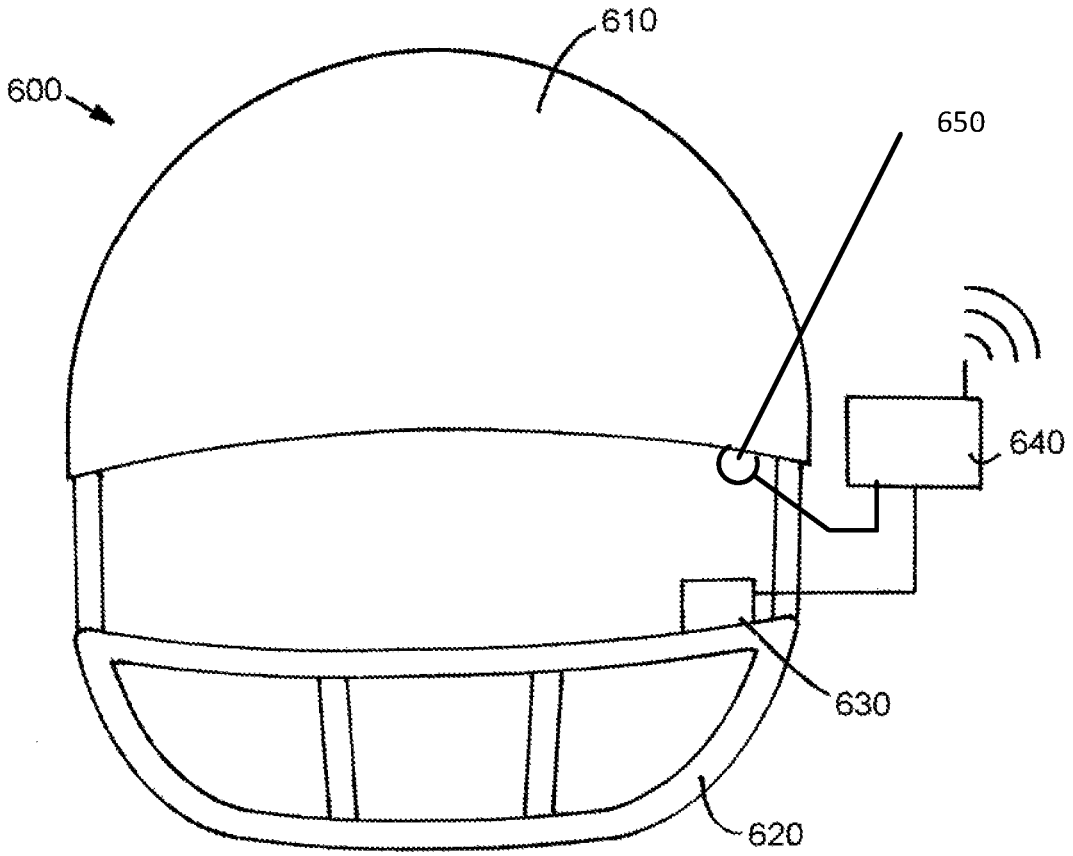
FIG. 7 illustrates a display situated to a football helmet providing a timer within a view of the wearer, in accordance with the present disclosure.

Headgear used in sports can include electronics. In football, a quarterback can receive an audio signal from coaches located on the sideline. FIG. 7 illustrates a display situated to a football helmet providing a timer within a view of the wearer. Helmet system 600 is illustrated. A wearer can view objects and other players through opening 610. A facemask 620 is connected to the helmet to protect the wearer. A display 630 can be configured to the helmet such that a number such as a countdown timer can be projected upon the display. In place of a small rectangular display, a visor can be configured over opening 610. A small display, a visor, or a portion of a visor can be configured to display graphics though methods known in the art. The helmet system 600 can include controller device 640 in communication with a remote server in order to display a correct number or timer upon display 630. Although controller device 640 is illustrated next to the helmet, one will appreciate that the controller device can be located within the helmet or can be partially or fully embodied within components located remotely from the helmet. Additionally, a helmet mounted miniature camera/video recorder and transmitting system 650 in communication with controller device 640 is illustrated optionally mounted within the helmet. Such a camera system could be used to provide augmented views for a telecast, for example, showing the timer in the view of the quarterback getting ready to expire as the play begins. In other embodiments, images from the camera can be used in instant replay/booth reviews of details from a play.

Figure 8:
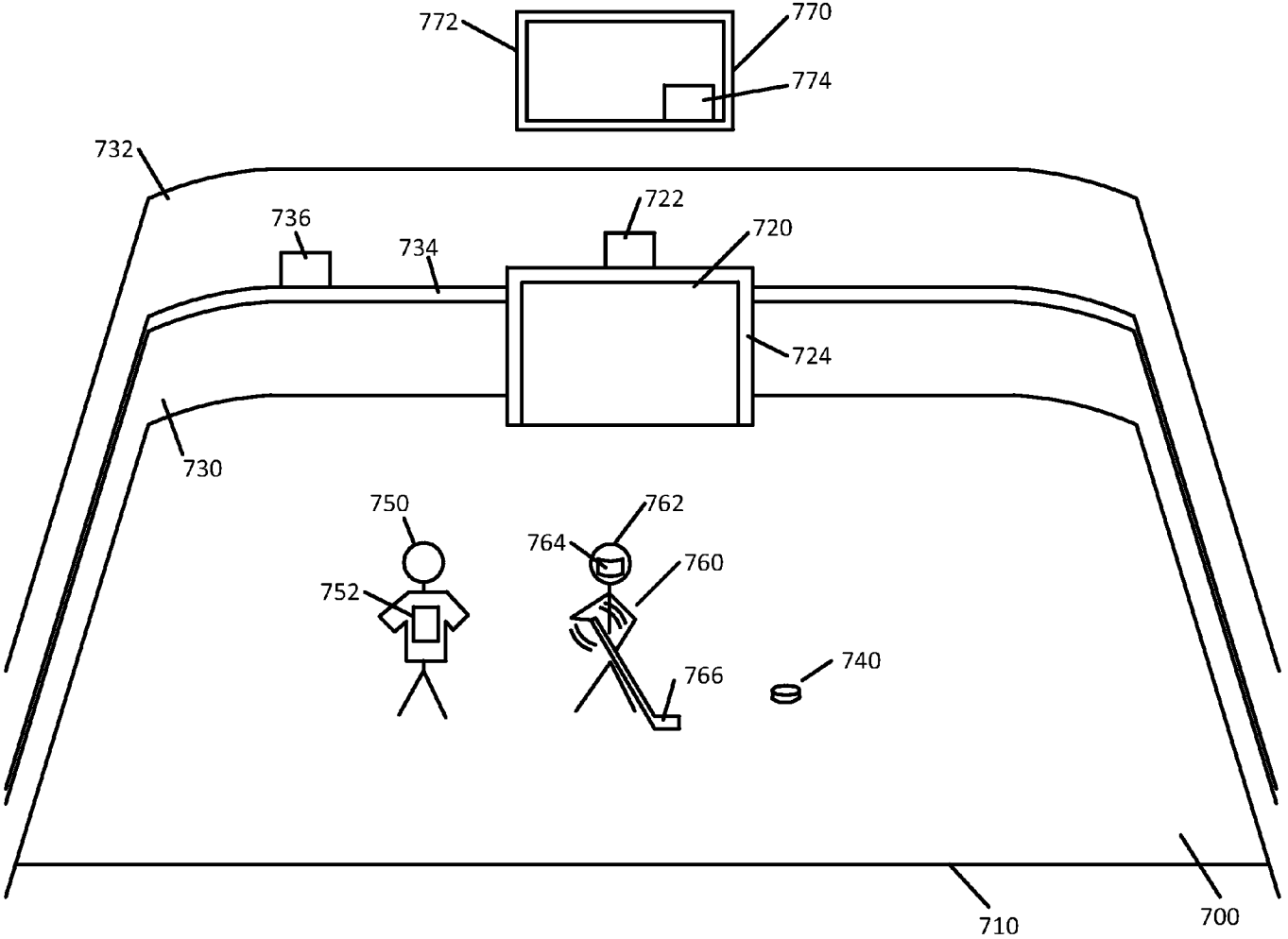
FIG. 8 illustrates an exemplary playing surface for a hockey game including coordinated timer display units, in accordance with the present disclosure.

FIG. 8 illustrates an exemplary playing surface for a hockey game including coordinated timer display units. According to the disclosed system, a plurality of timer units capable of communicating a game timer to players on a playing surface can be provided simultaneously upon or proximate to the playing surface. Hockey rink 700 includes playing surface (ice) 710, goal 720, and boards 730. Hockey puck 740, referee 750, and hockey player 760 are illustrated upon surface 710. Surface 710 includes markings including blue line 712. Timer units can be installed to goal 720 including a light emitting halo 724 situated around the goal posts and a digital display 722 located on a top goal post providing a display of timer digits. Upon a basketball court, a similar digital display and halo light system could be used upon and around a backboard. Upon a football/soccer field, a similar digital display and halo light system could be used upon and around a goal. Timer units can be installed to boards 730 including halo lights 734 around a top of the boards 730 and a digital display 736. A timer unit can be installed to hockey puck 740, for example, causing a clear plexiglass portion of the puck to glow red when a particular time in the game is reached or when a power play is about to expire. Methods known in the art can be employed to ensure that the weight and weight distribution within the puck 740 are unaffected by the addition of the timer unit. Referee 750 can wear a timer unit 752 as illustrated by the timer unit of FIG. 4. Player 760 can wear a helmet system 762 providing a display upon visor 764, and handle of hockey stick 766 can be made to vibrate according to methods known in the art. Halo lights, digital displays, glowing pucks, and other timer units can be used to communicate a countdown such as an impending end of a period, an end of a power play, a puck crossing blue line 712, scoring of a goal, or any of a number of different events within the game. Each of the goal, the referee, the player's helmet and stick, and the puck can be considered a moving object within the context of the game play. Additionally, a score keeper's booth 770 is illustrated behind the goal, including a timer display 772 and a halo 774 which can be activated similarly to the other timers and halo displays disclosed herein.

Figure 9:
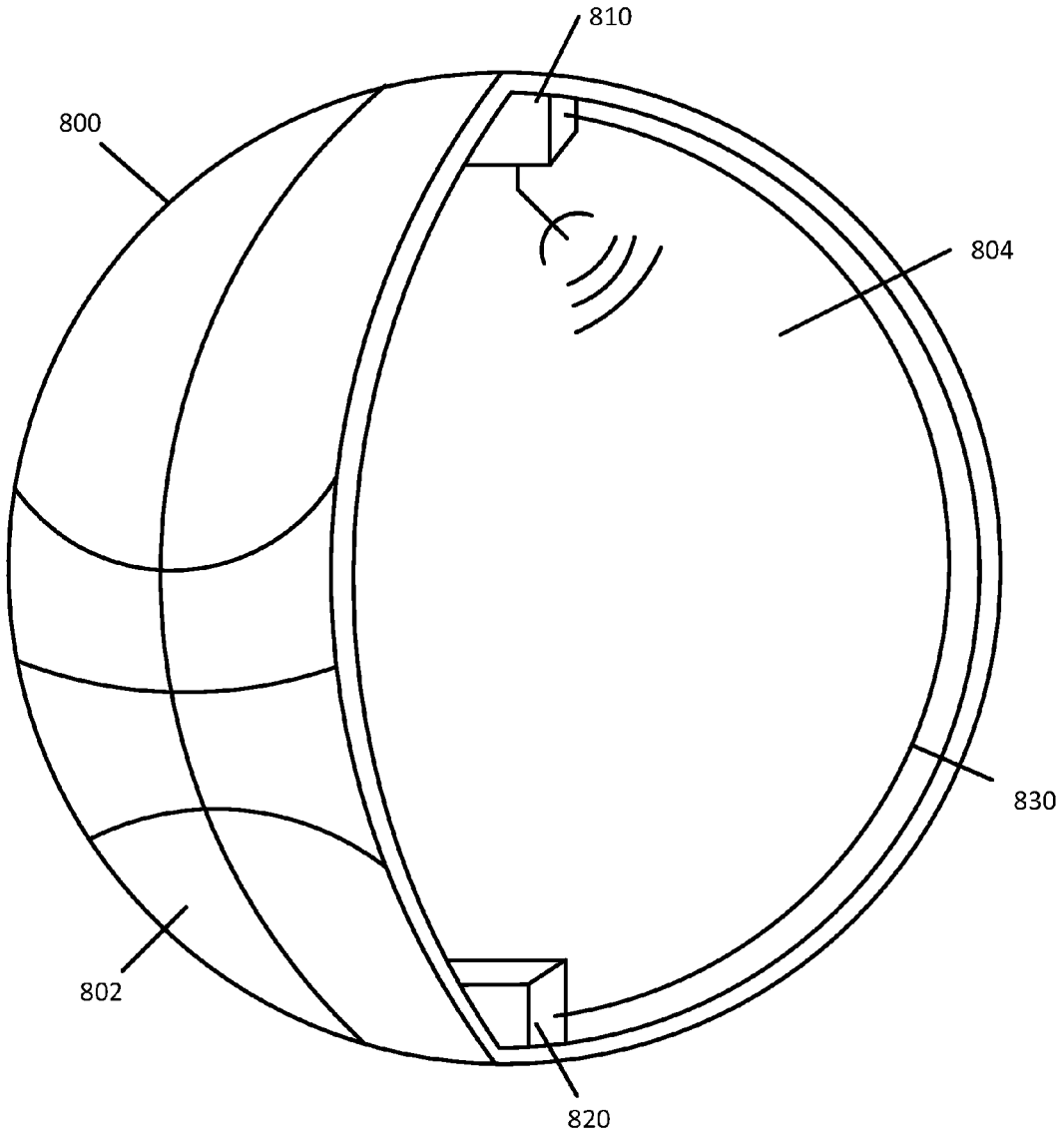
FIG. 9 illustrates an exemplary basketball including a vibrating timer unit, in accordance with the present disclosure.

FIG. 9 illustrates an exemplary basketball including a vibrating timer unit. Basketball 800 includes outer surface 802. An interior 804 of the basketball is shown in cut-away section. A timer unit controller 810 is illustrated in remote communication with a remote controller unit. A vibrating unit 820 is illustrated at a distal end of basketball 800 from controller 810. Controller 810 can received a command to vibrate according to a timer or game clock, such that controller 810 can use vibrating unit 820 to communicate to a player holding the ball that the clock is about to expire. The controller 810, the vibrating unit 820, and wiring 830 connecting the two can be distributed and secured within the ball such that the weight and weight distribution for the basketball are unaffected by the addition of the timer unit. Such devices located within a sealed ball can include induction charging stations known in the art where a magnetic field is used to charge batteries within the ball without having to physically remove the batteries from the ball. Similar vibrating devices can be fitted to a football, water polo ball, rugby ball, or any other similar ball.

The included timers can be configured upon a field and/or provided within the view of players, coaches, and staff in an equal and fair manner such that both teams have equal access to the timer information displayed. For example, if one player gets a timer display in a helmet, all players can have a timer display in a helmet. In another embodiment, the quarterbacks on each team can have a display in a helmet. Additionally, each of the centers that hike the ball to the quarterback can have a display in a helmet. A feedback system can be used, such that if one team's displays, either in helmets or on pole displays, are disabled or inoperative, then the timers displayed to the other team can be automatically disabled.

Controllers, master timer controllers, and other similar devices disclosed herein include computerized devices known in the art. Such devices include exemplary computerized hardware including a processor device, a storage device, and random access memory. Such devices are configured to operate processes embodied as programmed code or computerized subroutines known in the art. Communications devices utilize wireless technology known in the art such as cellular communications networks. The disclosed apparatus, system, and methods to operate the disclosed processes can be operated on general purpose computers, or specifically manufactured and purposed or dedicated computerized controller devices can be used to operate the functionality of the controller devices disclosed herein. Operation of a controller can be achieved within a single physical device or can span multiple physical devices.

As disclosed herein, a camera device can be included in a helmet system including timer devices. Additionally or alternative, the location of a timer controller within the field of play can opportunistically be used to provide camera views of different parts of views of the playing field. For example, a referee wearing a timer equipped shirt could also have a mini camera that could be used to provide viewers of a telecast or viewers in a replay booth a view of what the referee saw on a particular play. Camera/video devices disclosed herein are computerized systems for capturing an image or a series of images and are well known in the art to include small systems that can be worn by a user and used to provide wireless signals including electronic files of the capture image or images.

A mobile timer unit can be controlled according to a number of schemes depending upon the sport it is being used for. For example, in football and basketball, a play clock or shot clock are normally a most pressing countdown that a player needs to be aware of. However, as a game timer is running out, indicating an end to a quarter or period, the game clock can become the most pressing countdown. The outputs can be made to switch which countdown is being displayed based upon a particular criteria, for example, switch from a play clock to a game clock in the last minute of a quarter. Such a display can be color coded to avoid a player getting confused over which countdown is being displayed. The display can be configured to switch from whole numbers to fractional numbers, such as tenths of a second, at a particular time in a countdown. An output device can be configured to provide an output corresponding to a locational precondition of a game piece, such as a ball or puck, for example, illuminating when the game piece crosses a particular line or a score is advanced.

Timer display devices can be rigidly attached to the pole to which they are attached. Timer display devices can be separable from the pole to which they are attached. In one embodiment, a snap detent device can be used to releasingly attach the timer display device, permitting quick release of a timer device as required with a push of a button. The timer display device can be entirely self-contained with all electronics and battery devices being contained within the device. Battery devices can be rechargeable. The system can operate as a direct current system to any electrical standard known in the art. Exemplary devices can operate on 12 or 24 Volts.

Colors of displays can be standardized for a particular sport, such that a pulsing yellow light always means the same at events within a particular sporting league. In another embodiment, light schemes can be adapted for a particular team, for example, matching team colors.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a mobile timer unit for use in a sporting event, the apparatus comprising:

the mobile timer unit comprising a timer unit controller in communication with a remote master timer controller; and an output device in communication with the timer unit controller, the output device comprising a digital display communicating a timer countdown;

wherein the mobile timer unit is operated wirelessly upon a moving object within context of game play of the sporting event; and wherein the digital display is located on a hockey goal post.

2. An apparatus comprising a mobile timer unit for use in a sporting event, the apparatus comprising:

the mobile timer unit comprising a timer unit controller in communication with a remote master timer controller; and an output device in communication with the timer unit controller;

wherein the mobile timer unit is operated wirelessly upon a moving object within context of game play of the sporting event wherein the output device comprises a colored light configured to illuminate in accordance with a precondition comprising a game piece satisfying a particular location condition.

3. An apparatus comprising a mobile timer unit for use in a sporting event, the apparatus comprising:

the mobile timer unit comprising a timer unit controller in communication with a remote master timer controller; and an output device in communication with the timer unit controller, the output device comprising a colored light configured to illuminate in accordance with a precondition;

wherein the mobile timer unit is operated wirelessly upon a moving object within context of game play of the sporting event wherein the output device is located upon a pole comprising:

a sideline marker utilized in American football; and a camera device.

4. An apparatus comprising a mobile timer unit for use in a sporting event, the apparatus comprising:

the mobile timer unit comprising a timer unit controller in communication with a remote master timer controller; and an output device in communication with the timer unit controller, the output device comprising a halo light device comprising a colored light configured to illuminate in accordance with a precondition;

wherein the mobile timer unit is located on and operated wirelessly upon a moving object within context of game play of the sporting event, the moving object comprising posts of a hockey goal.

5. An apparatus comprising a mobile timer unit for use in a sporting event, the apparatus comprising:

the mobile timer unit comprising a timer unit controller in communication with a remote master timer controller; and an output device in communication with the timer unit controller, the output device comprising a vibrating device;

wherein the mobile timer unit is located and operated wirelessly within a moving object comprising a ball within context of game play of the sporting event.

6. An apparatus comprising a mobile timer unit for use in a sporting event, the apparatus comprising:

the mobile timer unit comprising a timer unit controller in communication with a remote master timer controller; and an output device in communication with the timer unit controller;

wherein the mobile timer unit is located and operated wirelessly within a moving object comprising a helmet within context of game play of the sporting event.

7. The apparatus of claim 6, wherein the helmet comprises a camera device.

8. An system comprising a plurality of mobile timer units for use in a sporting event, the apparatus comprising:

the mobile timer units each located upon one of a plurality of sideline markers used in American football comprising:

a controller in communication with a remote master timer controller;

a display unit configured to display a countdown timer; and a halo light configured to illuminate a circular pattern around the display unit; and an enhanced television display controller providing coordinated enhanced graphics coordinated to operation of the mobile timer units to viewers of a telecast of the sporting event.

* * * * *